United States Patent [19]

Ernstsson et al.

[11] 4,213,795

[45] Jul. 22, 1980

[54] METHOD AND AN ARRANGEMENT FOR THE CLEANING AND STERILIZING OF A FILLER PIPE ON A PACKING MACHINE

[75] Inventors: Ernst G. Ernstsson, Staffanstorp; Hans O. I. Nantin, Trelleborg, both of Sweden

[73] Assignee: Tetra Pak International AB, Lund, Sweden

[21] Appl. No.: 876,105

[22] Filed: Feb. 8, 1978

[30] Foreign Application Priority Data

Feb. 18, 1977 [SE] Sweden ..... 7701818

[51] Int. Cl.[2] ..... B08B 5/00

[52] U.S. Cl. ..... 134/22 C; 134/170; 141/90; 141/91; 53/167

[58] Field of Search ..... 53/425, 426, 167; 134/166 C, 167 C, 168 C, 169 C, 170, 22 C, 171, 102; 141/90, 91, 93; 422/26, 291, 292, 302

[56] References Cited

U.S. PATENT DOCUMENTS

| | | | |
|---|---|---|---|
| 3,430,639 | 3/1969 | Roberts | 141/91 X |
| 3,677,272 | 7/1972 | Schrank et al. | 134/166 C |
| 3,716,083 | 2/1973 | Tuma et al. | 53/167 X |
| 3,850,207 | 11/1974 | Loliger et al. | 53/167 X |
| 3,912,535 | 11/1975 | Rauser | 53/167 X |
| 3,945,411 | 3/1976 | Skoli et al. | 141/91 |
| 3,964,526 | 6/1976 | Sindermann | 141/90 X |
| 4,024,896 | 5/1977 | Ishioka et al. | 141/90 |

FOREIGN PATENT DOCUMENTS

| | | | |
|---|---|---|---|
| 2310589 | 9/1974 | Fed. Rep. of Germany | 53/167 |

*Primary Examiner*—Horace M. Culver

*Attorney, Agent, or Firm*—Burns, Doane, Swecker & Mathis

[57] ABSTRACT

A method and an arrangement for the cleaning and sterilizing of a filler pipe on a packing machine are disclosed. A cleaning and sterilizing duct is provided which can be concentrically arranged around the filler pipe, which duct is closed at one end and in tight engagement with the filler pipe at its other end, while also being connected to a drainage duct. Cleaning or sterilizing fluid can flow through the filler pipe, into the sterilizing duct, to be discharged through the drainage duct.

4 Claims, 4 Drawing Figures

METHOD AND AN ARRANGEMENT FOR THE CLEANING AND STERILIZING OF A FILLER PIPE ON A PACKING MACHINE

BACKGROUND OF THE INVENTION

The present invention concerns a method for the cleaning and sterilizing of a filler pipe on a packing machine of the type which manufactures a continuous series of mutually connected packing containers from a web of packing material which containers, while in connection with one another, are filled with contents via the said filler pipe, to be subsequently separated from one another to form individual packing containers. The invention also concerns an arrangement for the realization of the method.

Packing machines for the packaging of milk or other liquid dairy products in disposable packages are known. A number of these machines manufacture filled packing containers by the continuous forming of one or more webs of packing material into individual packages. The forming usually takes place in a manner such that the packing web material or the webs are successively converted to liquid-tight packages, which, however, are not separated from one another, but hang together, so that a more or less tubular material body, consisting of a number of packages, is formed. During the manufacturing process the material moves downwardly through the packing machine and the tube thus grows at its upper end. Through this upper end extends a pipe through which the product, which is to fill the packages, can enter into the packing material tube. Inside the packing material tube the pipe passes over into the filler pipe proper which extends concentrically downwardly through the packing material tube and during the production of the packages continuously supplies contents in such a quantity that the packing containers located at the bottom end of the tube are filled to the required extent. When a package, which at a certain instant forms the lowest part of the tube, has been filled with contents to the required extent, it is separated from the series of packages or the tube located above by means of a pressing together of the tube walls in a transverse zone. Subsequently a sealing together of the compressed tube walls takes place. The finished package is separated from the packing material tube following a cutting through the sealing zone.

In the packing machines of the above-mentioned type, as in all machines for the packaging of foodstuffs, high standards of hygiene must be maintained. Thus it must be possible to clean and sterilize in a simple and effective manner the parts of the machine which come into direct contact with this contents. This is facilitated in that the type of machine has only a small number of parts which come into direct contact with the contents, namely the filler pipe itself, through which the contents flow and the outside of which is surrounded by the contents located in the lower part of the material tube, and any liquid level detector located in the material tube. In the normal operation of the packing machine these parts are dismantled and cleaned before each prolonged interruption of production, such as, for example, every evening. After dismantling, a washing of the parts by hand takes place, whereupon they are assembled again in the machine which is started up and allowed to operate for a short while without any supply of contents, so that an empty material tube is formed which covers and protects the cleaned parts of the machine.

Before the machine is to be restarted for production, a sterilization of the parts coming into contact with the contents takes place wherein a sterilizing agent, e.g. superheated steam, is sprayed through the feed pipe and into the empty material tube, via the upper, open part. The machine is then ready for production.

Another known manner for the cleaning of the filler pipe exists wherein of the pipe is washed in situ in the machine, a cleaning agent, e.g. 2% caustic soda, being allowed to flow through the feed pipe in place of the contents and out into the tube in the same manner as described above for the sterilizing agent. The resistance and durability of the tube material, however, limit the permissible time of flow of the cleaning agent through the pipe and an optimum cleaning result cannot be obtained in this manner, so that cleaning by hand is preferred. However, cleaning by hand is also difficult, since the filler pipe is generally very long and frequently has a flattened section or tapers strongly towards the orifice end.

In packing machines which manufacture aseptic packages, that is to say packages with sterile contents, the hygiene standards are moreover so high that safety is jeopardized through the manual reassembly of the filler pipe in its place in the machine, necessarily after the washing by hand of the same.

OBJECTS AND SUMMARY OF THE INVENTION

It is an object of the present invention to provide a method for the cleaning and sterilizing of a filler pipe on a packing machine of the above-mentioned type, which method is simple, rational and provides effective cleaning and sterilizing. It is a further object of the present invention to provide an arrangement for the realization of the method of this invention.

This object has been achieved by the method of this invention wherein a packing machine of the type which web manufactures a continuous series of mutually connected packing containers from a packing material which while connected to one another are filled with contents via the said filler pipe, to be subsequently separated from one another so as to form individual packing containers, which machine is characterized in that a cleaning and sterilizing duct arranged mainly concentrically around the filler pipe is provided, the lower end of which, corresponding to the orifice end of the filler pipe, is closed and the upper end of which is on the one hand in tight engagement with the bottom end of the filler pipe, and is on the other hand connected to a drainage duct, whereupon a cleaning or sterilizing fluid is made to flow through the filler pipe, out into the said duct, and back along the outside of the filler pipe to be ultimately discharged through the drainage duct.

In one embodiment of the present invention an arrangement is provided which comprises a cleaning sleeve in the form of a pipe, closed at its one end, which has an inner shape corresponding to the outer shape of the filler pipe and is so dimensioned that when it is applied to the filler pipe it forms, together with the latter, a cleaning duct which is outwardly delimited by the inside of the sleeve and inwardly by the outside of the filler pipe, and the cross-sectional area of which substantially coincides with the inner cross-sectional area of the filler pipe.

In a preferred embodiment of the arrangement an upper, open end rests in tight contact against a flange arranged around the bottom end of the filler pipe.

In a further preferred embodiment of the invention a sleeve, close to its open end, has an opening for the connection to a drainage duct.

In a further preferred embodiment of the arrangement in accordance with the invention the connection between the sleeve opening and the drainage duct takes place by means of a bayonet catch, one part of which is fixed around the sleeve opening and the other part of which consists of a bayonet ring with internal thread which is supported by an external thread on a rotatable and axially displaceable pipe serving as a drainage duct.

In a further preferred embodiment of the arrangement in accordance with the invention the bayonet catch is so designed that the angle of rotation from uncoupled to coupled position amounts to maximum 45°, preferably 22,5°.

In a further preferred embodiment of the arrangement in accordance with the invention the end surface of the pipe is arranged to be pressed, so as to form a seal, against the corresponding end surface of the fixed half of the catch by screwing down of the pipe into the bayonet ring, after the bayonet catch has been brought into its locked position.

In a further preferred embodiment of the arrangement in accordance with the invention the cleaning sleeve is maintained in tight contact against the flange of the filler pipe by means of a lever which is adapted so that on screwing down of the pipe into the bayonet ring it engages with and is pressed against the side of the filler pipe flange which is remote from the sleeve.

In a further preferred embodiment of the arrangement in accordance with the invention one arm of the lever rests against a conical surface connected with the pipe, so that a screwing down of the pipe into the bayonet ring results in a pivoting of the lever and pressing of the sleeve against the flange of the filler pipe.

BRIEF DESCRIPTION OF THE DRAWINGS

The invention will be described in detail with reference to the enclosed drawings which schematically illustrate a preferred embodiment of the invention.

DETAILED DESCRIPTION OF THE INVENTION

Figure 1:
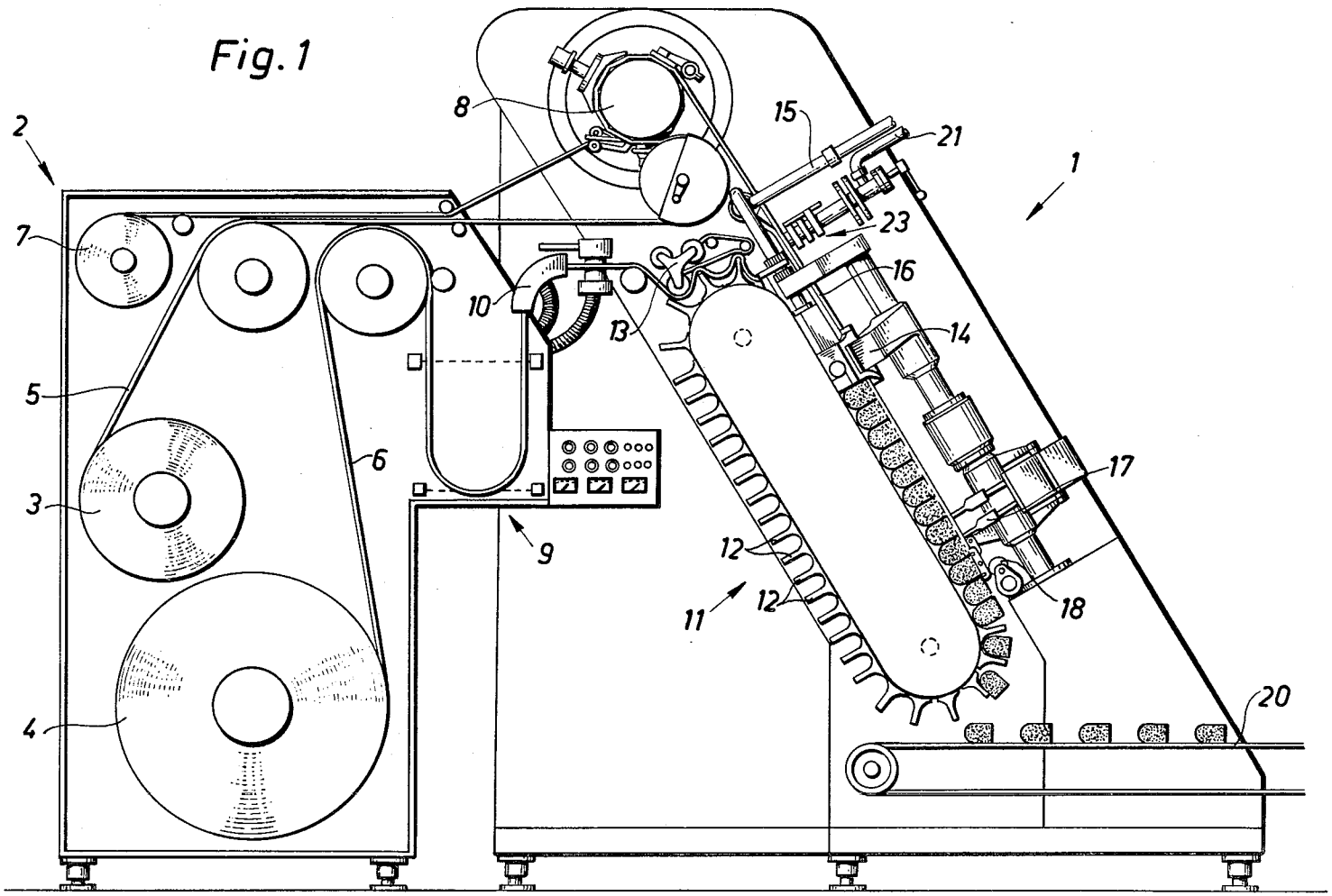
FIG. 1 shows a packing machine of a known type which is provided with an arrangement in accordance with the present invention so as to make possible the cleaning and sterilizing of the filler pipe in accordance with the method of the present invention.

FIG. 1 shows a packing machine of a known type which is provided with an arrangement for the realization of the method of the present invention. The packing machine consists of two main parts, namely the actual machine part 1 and a packing material part 2. The packing material part 2 comprises a so-called stand of rolls comprising magazine rolls of packing material. The rolls 3 and 4 carry packing material webs which consist of a central carrier layer coated on both sides with layers of homogeneous plastic material. The packing material webs 5 and 6 are rolled off the magazine rolls and are passed over guide rollers to the machine part 1. A further magazine roll 7 carries strip material of homogeneous plastic material which is intended for use as a removable cover layer over the pouring opening of the finished packages.

The main part 1 of the packing machine comprises a frame which carries a rotating drum 8 over which the packing material web 5 is passed and on which different operations are carried out at stations along the periphery of the drum. The operations which are carried out include e.g. the punching of pouring openings, the application of a cover layer of the pouring opening and the bending of folding lines. After these operations material webs 5 and 6 are combined.

The material web 6 is fed as it runs off the roll 4 via a photocell device 9, which controls the rate of advance, to a heating element 10 which heats the material web as a preparation for the forming of the same. The forming of the material web takes place in a forming unit 11 which comprises a number of movable mould components 12 which are connected together in the form of an endless chain which moves at a constant speed in clockwise direction in FIG. 1. The forming unit moreover comprises a forming tool 13 which is arranged so that it can rotate at the upper end of the mould chain and which is adapted to press the heated material web 6 down into the recesses of the moulds 12 following one another. After this forming the two material webs are combined so as to be moved jointly in the course of further operations in downwards direction along the righthand side of the mould chain. During the further processing a sealing together of the two material webs takes place with the help of further heating and sealing devices 14 to a continuous series or a tube of mutually connected packing containers which are continuously filled with contents via a feed line 15 and a filler pipe 16. At the lower end of the continuous packing units a sealing off of the individual, filled packing containers takes place by means of sealing jaws 17, which are then separated from one another by means of a cutting device 18. They are subsequently removed with the help of a conveyor belt 20 for collection or packing into larger, collective containers.

Figure 2:
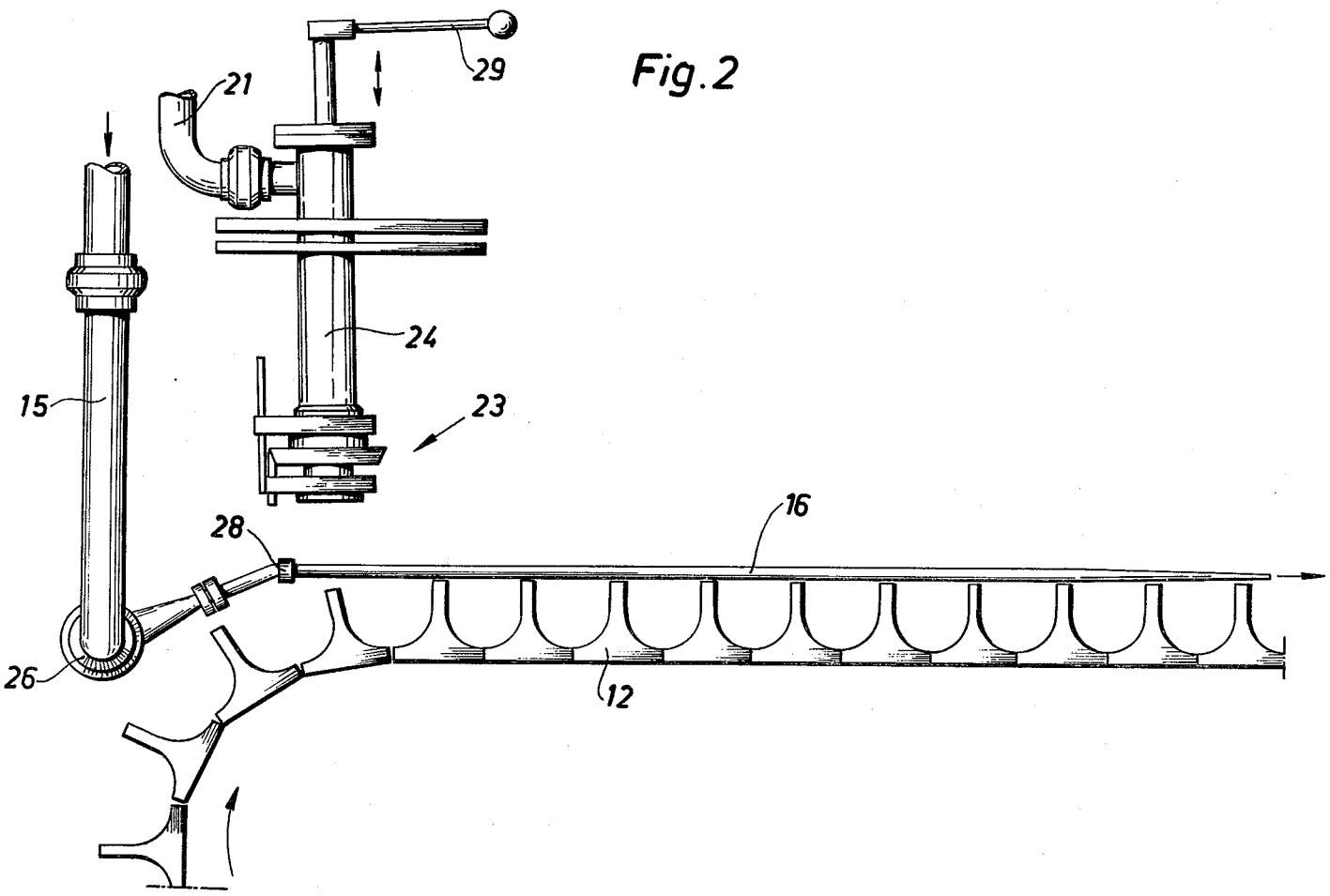
FIG. 2 shows on a larger scale part of the packing machine of FIG. 1 with the filler pipe in production position.
Figure 3:
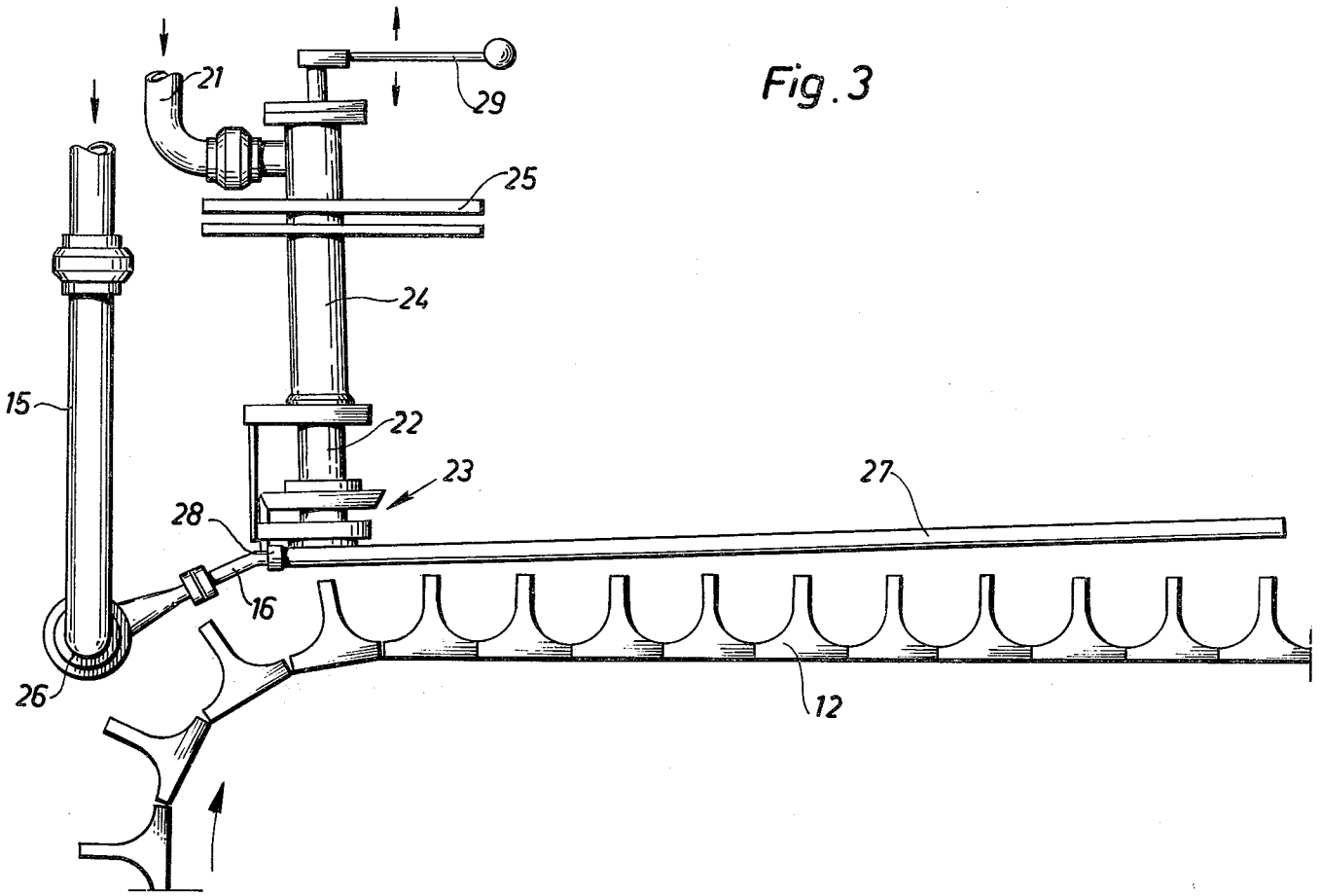
FIG. 3 is similar to FIG. 2 and shows the arrangement in cleaning or sterilizing position with applied cleaning sleeve and drainage duct.

FIG. 2 depicts, on a larger scale, part of the mould chain with the individual moulds 12, the feed pipe 15 for contents and the filler pipe 16 situated parallel to the mould chain. It should be noted that although the part of the mould chain parallel with the filler pipe 16 is shown in a horizontal position in FIGS. 2 and 3, in reality it extends at an angle relative to the horizontal plane as shown in FIG. 1, that is to say, at an angle of approx. 60°. Also shown in FIGS. 2 and 3 is a pipe 21 which together with a further pipe 22 and a coupling device 23 forms a drainage duct for the cleaning and sterilizing agent. The pipe 22 is supported so that it can rotate and is axially displaceable in a further pipe 24 which is stationarily connected to a part 25 of the machine frame. In the Figures the filler pipe 16 is connected to the feed pipe 15 via a joint 26 which allows a pivoting up of the filler pipe 16 at an angle of a few degrees against the mould chain (FIG. 3). This pivoting makes possible an application of a cleaning sleeve 27 to the filler pipe 16. The cleaning sleeve 27 is in the shape of a pipe, the lower end of which (that is to say to the right in FIG. 3) is closed and the upper end of which is arranged to make tight contact against a flange 28 on the filler pipe 16. The inside diameter or the cross-sectional area of the cleaning sleeve 27 is so much greater than the corresponding outside dimension of the filler pipe 16 that a cleaning and sterilizing duct is formed between the outside of the filler pipe and the inside of the cleaning sleeve, which duct has a cross-sectional area substantially corresponding to the inner cross-sectional area of the filler pipe. The sleeve 27 comprises further at its upper, open end an opening (not shown in the Figure) to allow a connection of the inside of the sleeve to the drainage duct by means of the coupling device 23. The drainage opening of the cleaning sleeve is closed by one half of a bayonet catch, whose mating half constitutes part of the coupling device 23. FIGS. 2 and 3 also show that the displaceable pipe 22 is provided at its upper end with a maneuvering handle 29 by means of which the pipe can be moved in the direction towards the cleaning sleeve, and be rotated so as to allow joining together with the cleaning sleeve.

The method in accordance with the present invention for the cleaning and sterilizing of a filler pipe on the packing machine described will now be described in detail with special reference to FIGS. 2 and 3. When the filler pipe is to be cleaned and sterilized, which may be the case e.g. after a day's production of packages, the more or less finished packages are removed which are present on the downwards moving, righthand part of the mould chain. This is done simply by cutting through the packing material with a knife, whereupon this can be wholly or partly removed. As a result the filler pipe 16 becomes accessible and the situation is that as shown in FIG. 2. Since the filler pipe runs parallel with and tightly adjoins the top surfaces of the moulds 12, it is impossible to apply the cleaning sleeve with the filler pipe in this position. Through the provision of the joint 26 on the feed pipe 15, however, it is possible to pivot the filler pipe 16 somewhat away from the moulds 12 to the position which is shown in FIG. 3 where the pipe is at an angle of approx. 3° to the mould chain. After this adjustment of the position of the filler pipe 16 the cleaning sleeve 27 is taken from its storage place on the machine and is slipped onto the filler pipe from the outlet end of the latter (to the right in FIGS. 2 and 3) and in the direction towards the left until the upper end of the cleaning sleeve 27 comes to rest against the flange 28 located at the corresponding upper end of the filler pipe 16. At the same time it is ensured that the cleaning sleeve 27 is turned in such a manner that its opening intended for coupling to the drainage duct faces towards the coupling 23. When the cleaning sleeve has thus been placed into the correct position, the handle 29 is gripped, with the help of which the pipe 22 and the coupling device 23 are displaced axially downwards until the bayonet catch of the coupling device 23 comes to rest in the corresponding coupling on the cleaning sleeve 27, whereupon a liquid-tight joining together of the cleaning sleeve and the drainage duct is achieved by turning the handle 29, at the same time as the cleaning sleeve is locked in tight contact against the flange 28. This procedure, together with the design of the coupling device 23 will be described in more detail later. After this joining together, the arrangement is ready for cleaning.

The cleaning takes place by allowing a detergent or cleaning agent, which e.g. may be 2% caustic soda (NaOH) or any suitable acid, to flow through the feed line 15 for contents which for this purpose is provided with a suitable valve of a known type. The cleaning medium then flows through the filler pipe 16 and out through its orifice end (to the right in FIGS. 2 and 3), where on contact with the closed bottom end of the cleaning sleeve 27 it changes direction and flows into the cleaning duct formed between the cleaning sleeve 27 and the outside of the filler pipe 16, as a result of which the outside of the filler pipe 16 is also effectively cleaned. When the cleaning medium reaches the upper end of the cleaning sleeve 27 it flows out via the coupling 23 into the drainage duct formed by the pipe 21 and 22 to an appropriate collecting vessel, not shown in the drawing. This washing and cleaning procedure may continue until the feed pipe 15, as well as the inside and outside of the filler pipe 16, have been scrupulously cleaned. Then the process is interrupted and the cleaning sleeve 27 is detached by maneuvering the handle 29 and put aside, whereupon the filler pipe 16 is pivoted back to its working position. Then the machine is restarted and allowed to operate without feed of contents until a series of empty packages has been produced, which packages jointly cover and protect the filler pipe 16 from contamination.

When the machine is to be started again for production, the parts coming into contact with the contents are initially sterilized. This sterilization is carried out by allowing any suitable sterilizing agent, e.g. superheated steam, to flow through the machine in the same way as described earlier for the cleaning agent, that is to say through the feed line 15 for contents, via the pivotable coupling 26 out into the filler pipe and from there out at the lower end of the continuous row of packages which surround the filler pipe. Inside the packing material tube the steam flows upwards to be finally discharged at the upper, open end. After superheated steam has been passed through for a certain time, the machine is ready for starting production, which follows directly by substituting the steam by the contents, and the machine is started.

The method described for the cleaning and sterilizing of the filler pipe in two steps is very effective and can be carried out completely without human contact with the filler pipe thus providing a very high degree of sterilization appropriate for use in aseptic packing machines. In non-aseptic packing machines the design may be simplified in that the filler pipe does not need to be sterilized in situ, but can be detached from the feed pipe and introduced into a special cleaning sleeve which in principle is identical to the cleaning system described, but is fixed at some suitable place on the machine or in a separate washing machine which may be common to several packing machines. In this method the same high degree of sterilization cannot be obtained, since a certain risk of re-infection exists during the assembling of the sterilized filler pipe 16, but the design is simpler and, among other things, the articulated joint 26 may be omitted.

When the packing machine operates with a packing material which does not allow the use of superheated steam or other sterilizing agent (e.g. packing laminate containing layers of foamed thermoplastics) and therefore cannot be used as a sleeve around the filler pipe in the sterilization, a somewhat different method is used instead. After the cleaning or washing, which takes place in the above-mentioned manner irrespective of the packing material being allowed to remain to the greatest possible extent in place in the mould chain and, in other words, partly covering the cleaning sleeve, the cleaning sleeve may remain on the packing machine. The subsequent sterilization by means of superheated steam now takes place with the cleaning sleeve in position, whereupon it is removed while the filler pipe continues to be covered for the most part by the previously made series of packages. During the whole procedure the filler pipe as well as the material web are protected by a protective cover on the packing machine. The new, sterile packing material is advanced and the production of packages is resumed.

Figure 4:
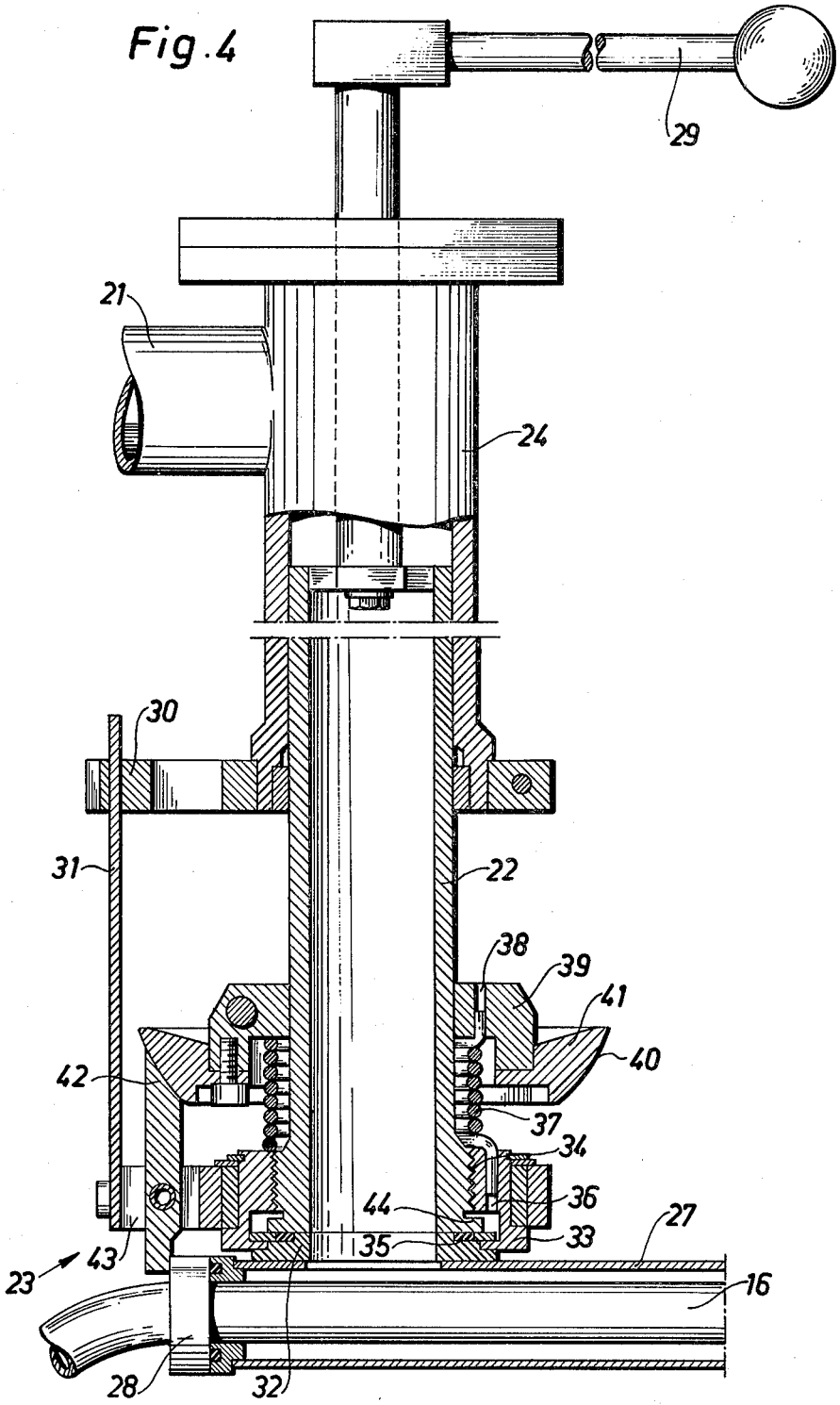
FIG. 4 shows in section a coupling arrangement for connecting cleaning sleeve and drainage duct or cleaning sleeve and filler pipe.

The coupling device 23 for the joining together of the drainage opening of the cleaning sleeve 27 with the drainage duct and for the retaining of the cleaning sleeve on the filler pipe is shown on a larger scale in section in FIG. 4. In the Figure the pipe 22 which constitutes part of the drainage duct and which at its upper end carries the handle 29 and at its lower end carries the actual coupling unit 23 are shown. The pipe 22, as mentioned previously, is supported in an outer pipe 24 so that it can rotate and be axially displaced, which outer pipe 24 in turn is fixed to the frame of the machine. At the lower end of the pipe 24 an attachment 30 is provided which carries a guide 31, extending axially in respect of the pipe, the function of which will be described later.

At the lower end of the rotatable and axially displaceable pipe 22 are coupling elements for the liquid-tight joining together of the pipe 22 with the bayonet socket 32 of the cleaning sleeve 27. These elements more particularly consist of a bayonet ring 33, co-operating with the bayonet socket 32, which via an internal thread 34 located above the actual locking part is supported by the lower end of the pipe 22. The lower end surface of the pipe 22 is formed as a sealing surface and is adapted so that it can be jointed in a liquid-tight manner via a washer 35 to the upper surface of the bayonet socket 32. In the upper surface of the bayonet ring 33 is an axial bore 36 in which is fixed one end of a helical spring 37. The opposite end of the spring 37 is fixed in a corresponding manner in a bore 38 in a ring 39 which is fixed to the pipe 22. The spring fixed between the ring 39 and the bayonet ring 38 is assembled with initial tension which means, that when the bayonet ring is not engaged with the bayonet socket 32 on the cleaning sleeve, it acts upon the bayonet ring so that the same is screwed downwards until the lower end of the threaded part 34 comes to rest against a projection 44 on the pipe 22. The ring 39 supports moreover a ring 41 provided with a downwardly directed, substantially conical surface 40. The surface 40 of the ring 41 is adapted so that it co-operates with the upper end of a lever 42 which is supported pivotably in a holder 43, which in turn is supported so that it can rotate on the bayonet ring 33. The holder 43 is rigid with respect to the pipe 24 and this is ensured by means of the guide 31 which has the form of a bar engaging in a recess in the holder 43 preventing the latter from turning.

When the pipe 22 is to be joined together with the drainage opening in the cleaning sleeve 27, the coupling unit 23 is in a state of readiness in which the bayonet ring 33 has been screwed downwards by the spring 37 to rest against the projection 44. The pipe 22 has been displaced axially upwards with the help of the maneuvering rod 29 so that the top side of the ring 39 rests against the bottom end of the pipe 24. After the pivoting up of the filler pipe 16 in the joint 26 described earlier and the application of the cleaning sleeve 27 to the filler pipe, the pipe 22 is moved axially downwards until the bayonet ring 33 slides into the recess in the bayonet socket 32. Then the pipe 22 is rotated in clockwise direction, which causes the bayonet ring 33 under the effect of the spring 37 also to be rotated in clockwise direction. After a certain angle of rotation, preferably 22.5°, the bayonet ring is fully coupled together with the bayonet socket and cannot be rotated further. Further rotation of the pipe 22 will now cause the pipe to be screwed downwards with the help of the thread 34 into the stationary bayonet ring until its bottom end surface comes to rest against the upper surface of the bayonet socket, where the washer 35 ensures a good seal. This is achieved after a further rotation of approx. 250° after the bayonet ring has reached its locked position. The joining together between cleaning sleeve and drainage duct is now complete.

As mentioned previously, the coupling unit 23, at the same time as joining together the bayonet socket, also provides a clamping of the cleaning sleeve 27 in tight contact against the flange 28 provided on the filler pipe. This is achieved in that the bottom end of the lever 42, in conjunction with the axial lowering of the pipe 22 for the engagement of the bayonet catch, is lowered at the side of the flange 28 which is remote from the cleaning sleeve 27. During the subsequent rotation of the pipe 22, the ring 39 as well as the ring 41 and the conical surface 40 arranged on the bottom side of the same will be rotated and displaced axially downwards against the cleaning sleeve. Through cooperation between the substantially conical surface 40 and the upper slanting end of the lever 42, the lever 42 will be made to pivot about its point of support in the holder 43 so that its bottom end is pressed against the flange 28, which, with the assistance of a certain play between the pipe 22 and the pipe 24, causes the cleaning sleeve 27, via the bayonet catch and the pipe 22, to be pressed into tight engagement with the flange 28.

The coupling unit described above enables the necessary joining together of the cleaning sleeve with the filler pipe as well as with the drainage duct to be achieved in a secure manner in one instant when a cleaning of the filler pipe is to be carried out by the method in accordance with the invention.

We claim:

1. A method of cleaning and sterilizing a filler pipe on a packing machine of the type wherein a series of packing containers are filled through an orifice end of said filler pipe and said filler pipe includes a flange extending therefrom comprising:

providing a cleaning sleeve having a closed end, an open end, and a port which allows communication with the interior of said cleaning sleeve;

placing said cleaning sleeve in spaced concentric relationship to said filler pipe such that said closed end is in spaced relation to said orifice end of said filler pipe and said open end abuts said flange and is in sealing relationship therewith;

coupling a discharge tube to said cleaning sleeve in overlying sealing relationship to said port, said discharge tube including an annular ring having a frustoconical surface and a lever which is pivotably mounted to said discharge tube, one end of which cooperates with said frustoconical surface as said discharge tube is coupled to said sleeve to pivot said lever and cause a second end of said lever to engage said flange and secure the sleeve thereto; and thereafter causing a cleaning fluid to flow sequentially through said filler pipe, into the space between said cleaning sleeve and said filler pipe, and into said discharge tube for a time sufficient to cleanse said filler pipe.

2. The method of claim 1 wherein the cross-sectional area between said cleaning sleeve and said filler pipe is substantially equal to the cross-sectional area of the interior of said filler pipe.

3. An arrangement for the cleaning and sterilizing of a filler pipe on a packing machine of the type wherein a series of packing containers are filled through an orifice end of said filler pipe and said filler pipe includes a flange extending therefrom comprising:

a cleaning sleeve having a closed end and an open end, said sleeve being placed over and in spaced concentric relationship to said filler pipe, said closed end being in spaced relation to said orifice end of said filler pipe, said open end abutting said flange and said sleeve being provided with a port to allow communication with the space between said filler pipe and said sleeve;

a discharge tube including an annular ring provided with a frustoconical surface;

means to clamp and seal said discharge tube in overlying relationship to said port;

a pivotably mounted lever having first and second ends, said first end cooperating with the frustoconical surface of said annular ring upon clamping of the discharge tube in overlying relationship to said port so as to pivot said lever such that said second end engages said flange and cooperates to secure the sleeve thereto.

4. The arrangement of claim 3 wherein the cross-sectional area between the cleaning sleeve and the filler pipe is substantially equal to the cross-sectional area of the interior of the filler pipe.

* * * * *